United States Patent [19]

Epis

[11] Patent Number: 4,465,109

[45] Date of Patent: Aug. 14, 1984

[54] LOOM DOBBY CONTROL UNITS

[75] Inventor: Olivo Epis, Ponte Nossa, Italy

[73] Assignee: Fimtessile Fabrica Italiana Macchinario Tessile S.p.A., Italy

[21] Appl. No.: 405,360

[22] Filed: Aug. 5, 1982

[30] Foreign Application Priority Data

Aug. 6, 1981 [IT] Italy ..... 23412 A/81

[51] Int. Cl.[3] ..... D03C 1/00; D03C 1/26; D03C 1/06

[52] U.S. Cl. ..... 139/68; 139/331

[58] Field of Search ..... 139/66–74, 139/331

[56] References Cited

U.S. PATENT DOCUMENTS 4,326,562 4/1982 Palau ..... 139/68

FOREIGN PATENT DOCUMENTS 1230368 12/1966 Fed. Rep. of Germany ..... 139/71
1535207 3/1970 Fed. Rep. of Germany ..... 139/68
2744422 4/1978 Fed. Rep. of Germany ..... 139/68
48-31946 10/1973 Japan ..... 139/71

*Primary Examiner*—James Kee Chi
*Attorney, Agent, or Firm*—Stevens, Davis, Miller & Mosher

[57] ABSTRACT

Improvements are made to members of a loom dobby control unit so as to allow structural separation between the reading unit and control unit. For this purpose, the reading unit rockers operate on the control unit by simple bearing and thrust contact with the horizontal needles which control the hook lifting rods. Moreover, the lifting blades for said rods are controlled together with the hook lowering plates by the motion of shafts which control the dobby knife oscillations.

4 Claims, 5 Drawing Figures

LOOM DOBBY CONTROL UNITS

BACKGROUND OF THE INVENTION

This invention relates to improvements in those members of a loom dobby control unit which directly cooperate with the dobby reading unit members, in order to allow complete structural separation between the two units. Such separation leads to considerable constructional advantages, and in particular improves the dobby characteristics from the operational, maintenance and repair aspects.

SUMMARY OF THE INVENTION

According to the invention, the dobby reading unit is structurally separate from the control unit, the first unit acting on the second by bearing and thrust contact between tappets of the reading unit rockers and the ends of those horizontal needles of the control unit which control the vertical lifting rods for the hooks. These rods are pivoted at their lower end to levers which rock within comb-shaped stops, and engage the hooks by means of blocks of anti-impact material. Furthermore, the vertical movements of the lifting blades for said rods are produced by the action of the same levers which control the hook lowering plates, these levers being driven by a linkage comprising levers and connecting rods which is controlled by the same shafts which control the dobby knife oscillations.

BRIEF DESCRIPTION OF THE DRAWINGS

The invention is described hereinafter in greater detail by way of example, with reference to the accompanying drawings which represent one embodiment thereof and in which.

DESCRIPTION OF THE PREFERRED EMBODIMENT

Dobbies are mechanical apparatus by means of which the shed is formed in looms starting from a predetermined fabric design which is transferred in the form of code onto a punched tape, which when read by means of needles controls rocker levers which govern the movement of the heald frames.

Figure 1:
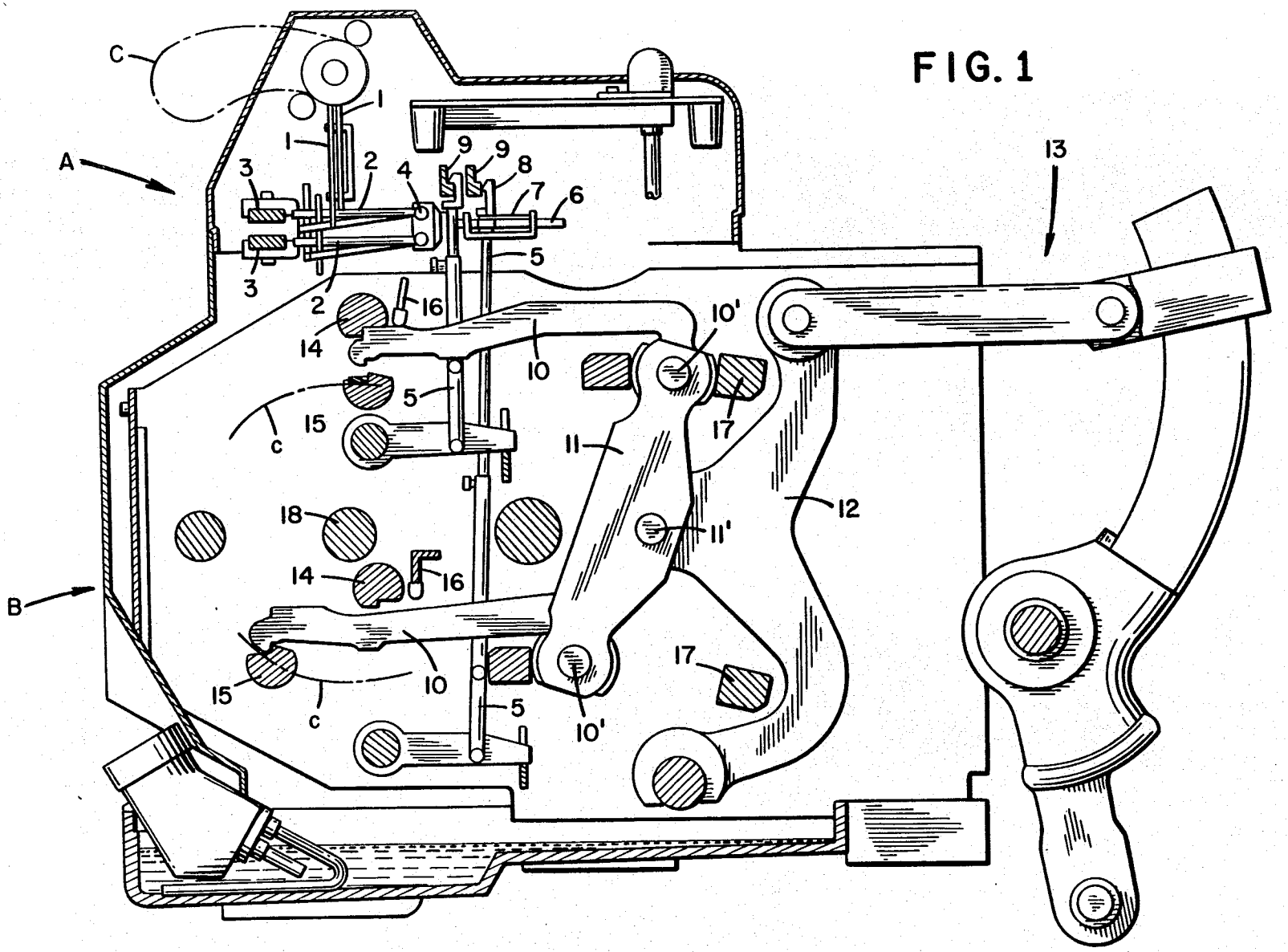
FIG. 1 is a general diagram of a dobby of known type incorporating the improvements according to the invention.

FIG. 1 of the accompanying drawings represents a diagram of a known Hattersley dobby. The purpose of the reading unit A is to read a punched paper tape C, and comprises reading needles 1, thrust rods 2 oscillating under the control of the needles 1, pressure bars 3 for engaging and thrusting the rods 2 selected by the needles 1, and control rockers 4 controlled by the rods 2. The purpose of the control unit B is to determine the movements of the heald frames under the control of the reading unit A, and comprises vertical control rods 5 controlled by horizontal needles 6 subjected to the actions of the rockers 4 and of return springs 7 in order to establish and remove the engagement with lifting blades 9 by way of upper end hook portions 8. It also comprises hooks 10 pivoted at 10' to the ends of rocker levers 11 which in their turn are pivoted at 11' to the centre of transmission levers 12 which operate lever systems 13 for controlling the heald frames. The vertical rods 5 engage with the hooks 10 in order to raise them and lower them in accordance with commands received from the rockers 4 of the reading unit A. The hooks 10 engage with fixed knives 14 and mobile knives 15 in order to control the rocker levers 11. Engagement with the fixed knives 14 occurs when the rods 5 raise the hooks under the control of the lifting blades 9 with which the hook portions 8 cooperate. Engagement with the mobile knives 15 occurs when the rods 5 do not exert positive force on the hooks. The movements impressed by the rocker levers 11 and transmission levers 12 on the lever systems 13 and thus on the heald frames, leading to the formation of the shed, derive from the combination of these engagements and the law governing the movement of the mobile knives 15.

It should be noted that in reality the fixed knives 14 have only their axes fixed, in the sense that they undergo oscillations about this latter for the purpose of facilitating their engagement with the hooks. In contrast, besides undergoing similar oscillation about their axes (again to facilitate engagement with the hooks), the mobile knives move such that their axes travel along trajectories in the form of circular arcs c.

It should also be noted that as a rule the hooks are lowered under the positive control of hook lowering plates 16 which ensure disengagement of the hooks from the fixed knives and facilitate their engagement with the mobile knives.

As stated, the present invention relates to improvements in those members of the control unit B which cooperate directly with the reading unit A which controls them.

The first and most important improvement according to the invention consists of having made the horizontal needles 6 which receive the command from the rockers 4 completely separate from these latter, so as to make complete physical separation possible between the reading unit A and control unit B, this being very useful both from the constructional aspect and in particular from the dobby operational and maintenance aspect. In the illustrated embodiment of the invention, the needles 6 are housed in supports 6' in which the return springs 7 act, and their end 6'' which faces the reading unit A makes contact with a tappet 4' of the rocker 4. In known manner, the needles 6 comprise seats 17 in which the upper portions 5' of the lifting rods 5 for the hooks 10 slide freely.

Figure 3:
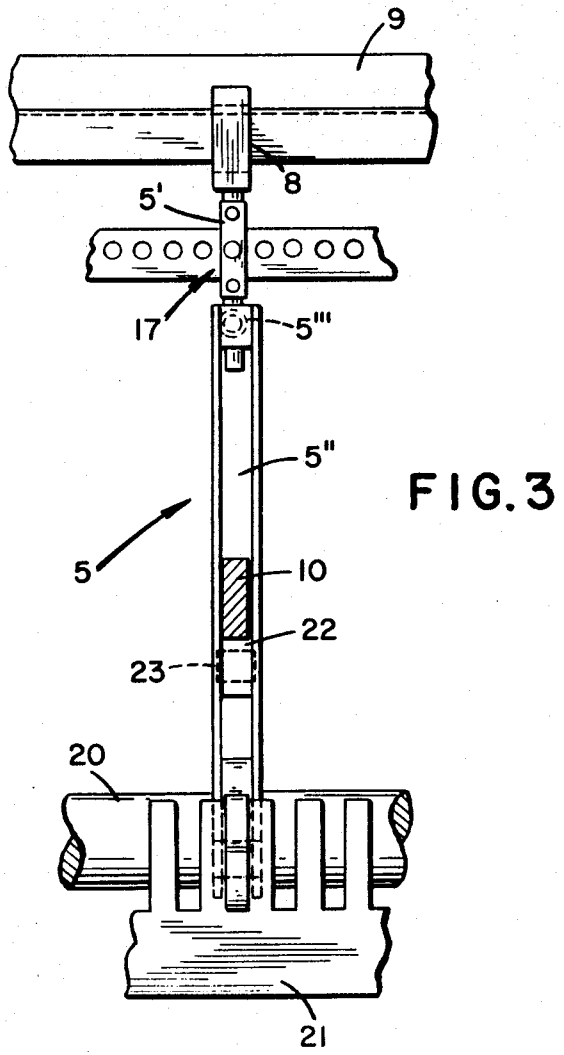
FIGS. 2 and 3 are two views at 90° apart of those parts of the dobby control unit according to the invention which directly cooperate with the reading unit, of which the rockers are shown.

According to the invention, the rods 5 comprise first portions 5' connected to the hook portions 8, and second portions 5'' which are rigidly connected at their upper end to these latter portions but with the facility for length adjustment at 5''', and are pivoted at their lower end at 18 to transverse levers 19 which rock at 20 and are braked downwards at their free end by stops 21 having a guide comb structure (see FIG. 3).

Figure 2:
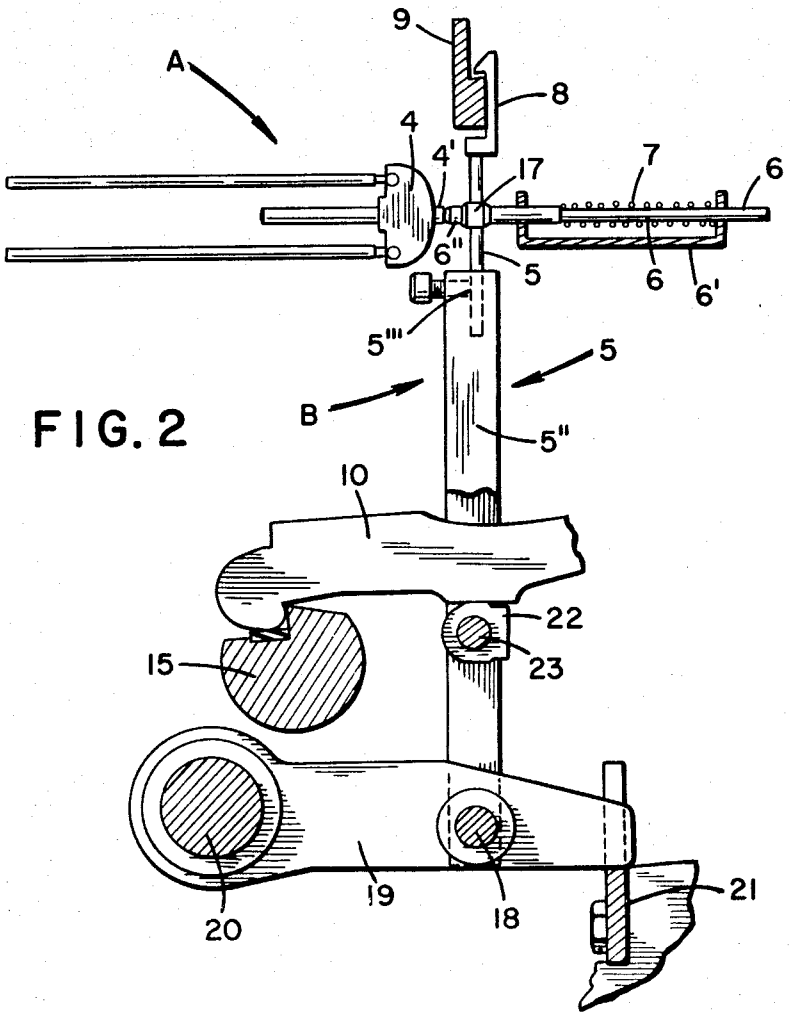

By means of this arrangement, the rods 5 can freely carry out the small oscillations which they are required to make (in the plane of the sheet containing FIG. 1 and perpendicular to the plane of the sheet containing FIG. 3) under the control of the needles 6, in order to engage with or disengage from the hook portions 8 of the lifting blades 9. The rods 5 are also guided transversely by the comb 21 which engages the levers 19 at their free end, so as to maintain the most correct and desirable position relative to the plane of FIG. 2 during dobby operation.

Figure 4:
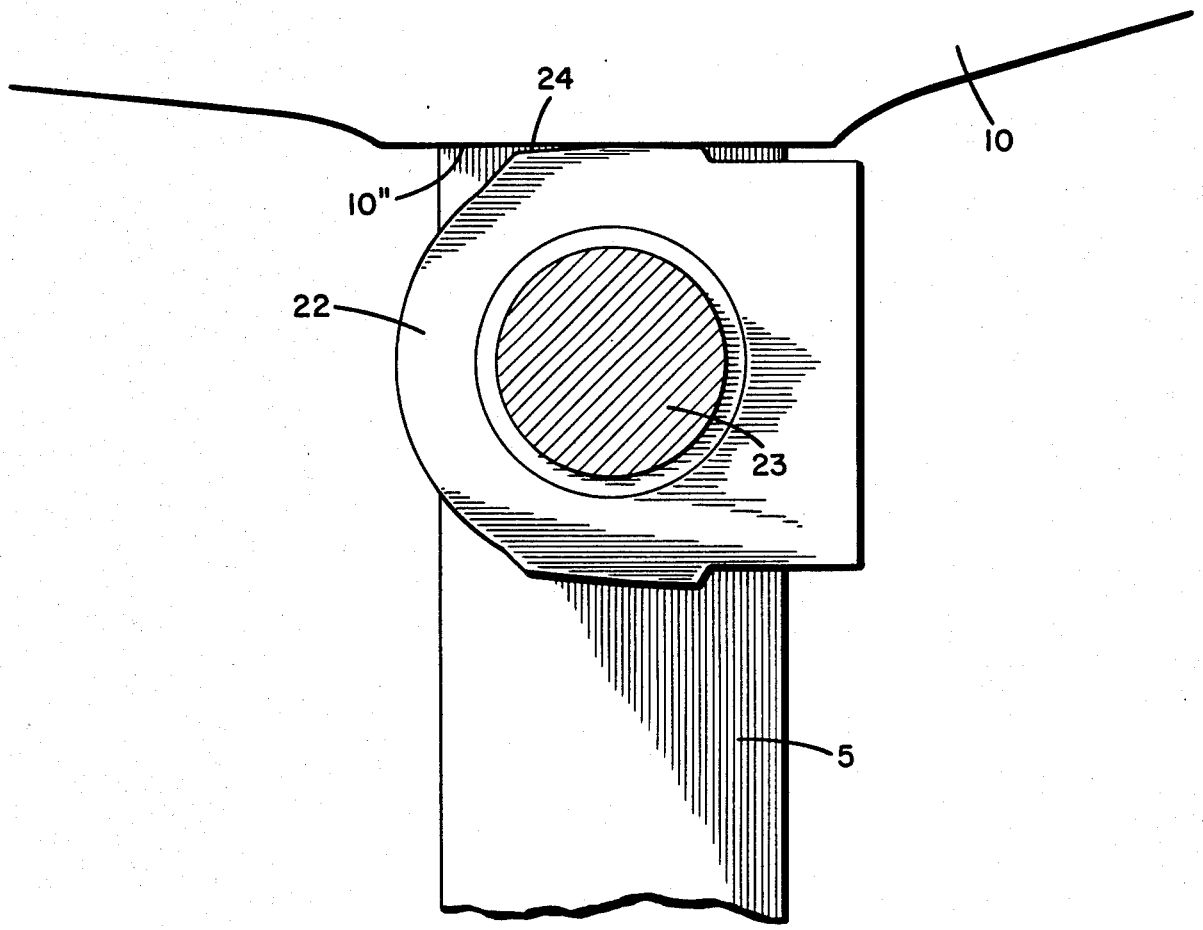
FIG. 4 is a detailed view to a greatly increased scale showing the engagement between the dobby ramp lifting rods and the ramps themselves.
Figure 5:
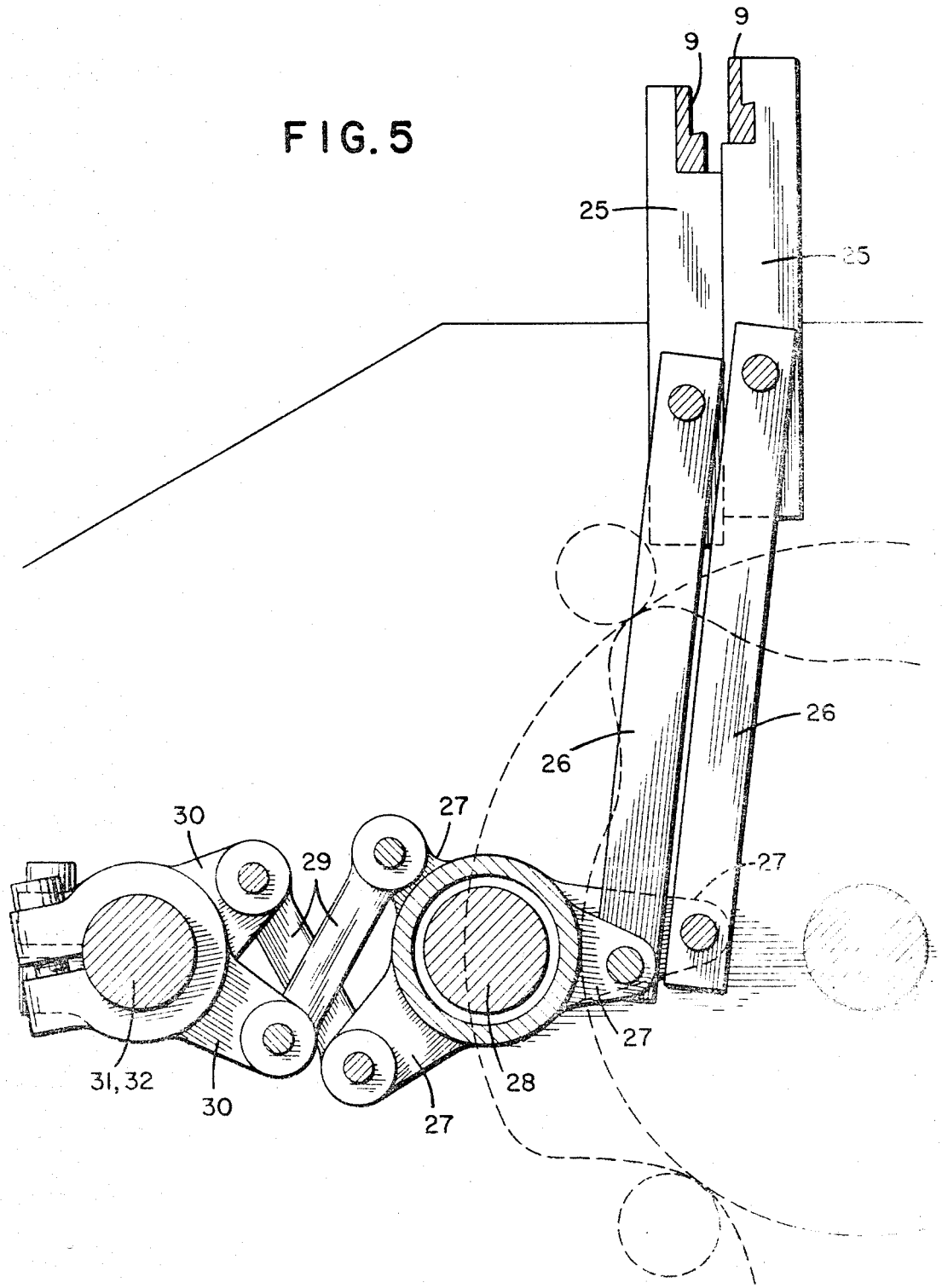
FIG. 5 shows the control linkage for the hook lifting blades.

The rods 5 engage the hooks 10 to lift them by way of blocks 22 (FIG. 4) of anti-impact material fixed to said rods by rivets 23. It should be noted that that side 24 of the blocks which comes into contact with the flat seat 10'' provided for this purpose on the hooks 10 is in the form of a convex surface.

This arrangement is very silent and precise, and represents important progress in dobby construction.

According to a further improvement of the invention, the lifting blades 9 for the hooks 10 are carried by plates 25 slidable in vertical guides (not shown), and are controlled by levers 26 which also serve for controlling the dobby hook lowering plate (not shown) and which are driven by a linkage comprising levers 27 swivel mounted about a fixed shaft 28 and controlled by way of connecting rods 29 from levers 30 keyed onto the same pins 31, 32 (abutting and aligned on a common axis) which control the oscillations of the fixed and mobile dobby knives about their axes.

This represents a very effective, precise and convenient control system.

The invention also covers embodiments different from that described or modifications thereto which do not leave the scope of the invention idea.

I claim:

1. A dobby for forming the shed in looms, comprising a reading unit having rockers and tappets for the fabric design which is in coded form on punched paper tape and a control unit having horizontal needles, vertical lifting rods, first levers and comb-shaped stops for the lever systems of the heald frames, said reading unit being structurally separate from the control unit, the reading unit acting on the control unit by bearing and thrust contact between tappets of the reading unit rockers and ends of said horizontal needles of the control unit which control the vertical lifting rods for hooks, said vertical lifting rods pivoting at a lower end to said first levers which rock within said comb-shaped stops which halt the rods in a downward direction and guide them laterally.

2. The dobby as claimed in claim 1, including hooks, said vertical rods carrying blocks of anti-impact material, said vertical rods lifting the hooks by way of said blocks of anti-impact material which engage with an appropriate flat surface of the hooks by way of a convex surface.

3. The dobby as claimed in claim 1 including blades, plates, second levers, third levers, connecting rods and shafts, said hook lifting rods being controlled by said blades, the vertical movement of which are produced by said plates movable under the action of said second levers which control dobby hook lowering plates, said second levers being driven by a linkage comprising said third levers and said connecting rods, said linkage being controlled by said shafts which control dobby knife oscillations about axes.

4. The dobby as claimed in claim 3 including fourth levers and a fixed shaft, said linkage comprising fourth levers swivel mounted about said fixed shaft, said third levers fixed to said shafts which control the knife oscillations and said connecting rods which connect said third and fourth levers together.

* * * * *